US006019632A

United States Patent [19]

Ozai et al.

[11] Patent Number: 6,019,632

[45] Date of Patent: Feb. 1, 2000

[54] MOUNT OF ELECTRICAL CONNECTOR

[75] Inventors: Kazuyuki Ozai; Hirokazu Takahashi, both of Tokyo, Japan

[73] Assignee: DDK Ltd., Japan

[21] Appl. No.: 08/954,806

[22] Filed: Oct. 21, 1997

[30] Foreign Application Priority Data

Nov. 25, 1996 [JP] Japan ..... 8-330308

[51] Int. Cl.[7] ..... H01R 13/74

[52] U.S. Cl. ..... 439/550; 439/564

[58] Field of Search ..... 439/550, 573, 439/544, 564

[56] References Cited

U.S. PATENT DOCUMENTS 5,632,648 5/1997 Liu ..... 439/550

*Primary Examiner*—Gary F. Paumen
*Attorney, Agent, or Firm*—Silverman, Cass & Singer, Ltd.

[57] ABSTRACT

A mount of an electrical connector serves to firmly mount the connector on an electrical appliance. One connector body of the electrical connector is to be fixed to a circuit board of the electrical appliance and has a housing as its outer casing whose mating connector socket is positioned in and spaced the connector opening formed in a panel plate of the electrical appliance. The mount is constructed as a clamp holder made of a resin including a fitting portion to be fitted on the outer circumference of the housing of the connector body fixed to the circuit board. The fitting portion of the clamp holder is also to be fixed to the panel plate in the state of the fitting portion being fitted on the outer circumference of the housing of the connector body so that the clamp holder made of the resin, the housing of the connector body and the panel plate are integrally fixed to one another. In this manner, the connector body can be fixed to the circuit board and the panel plate of the electrical appliance with great stability. Even if the housing of the connector body and the panel plate are made of conductive materials, insulation between them is maintained because of the clamp holder made of the insulating resin.

3 Claims, 7 Drawing Sheets

MOUNT OF ELECTRICAL CONNECTOR

BACKGROUND OF THE INVENTION

This invention relates to a mount of an electrical connector for firmly mounting the connector on an electrical appliance having circuit and panel boards.

With electrical or electronic appliances, as shown in FIGS. 5 and 6 one connector body 20 of an electrical connector 10 is often mounted on a circuit board 1 arranged in an electrical appliance in a manner such that a mating connector socket 21*a* forming part of the housing 21 of the connector body 20 as its outer casing is positioned in and spaced from a connector opening 2*a* formed in a panel plate 2 as part of a casing of the electrical appliance, thereby enabling a mating connector 30 to be inserted into the mating connector socket 21*a* of the housing 21.

The housing 21 forming the outer casing of the connector body 20 is made of a metallic material, for example, a copper plate coated with nickel plating or solder layer. As shown in FIG. 7, the housing 21 is provided on its bottom side with a plurality of legs 22 for fixing the housing to the circuit board 1. The legs 22 are fitted in fixing apertures (through-holes) formed in the circuit board 1 at predetermined positions and then fixed there at by soldering.

Such a soldering can be simply performed, for example, by moving along the surface of molten solder in a bath the circuit board 1 having the connector body 20 temporarily fixed thereto. This soldering method is effective owing to its high productivity and ensures the reliable fixation of a connector body 20 to the circuit board 1 substantially with a sufficient strength.

Therefore, even if the housing 21 of the connector body 20 is only positioned in and spaced from the connector opening 2*a* of the panel plate 2 in the manner described above, no troubles occur in use, so long as the mating connector 30 is accurately inserted into the socket 21*a* of the housing 21 taking particular precautions.

However, problems will arise with any inaccurate insertion of the mating connector 30 into the socket 21*a*, for example, in oblique directions misaligned with the correct insertion axis in every direction, or mishandling insertion. With such cases, the connector body 20 and the circuit board 1 fixed thereto by soldering would be subjected to great mechanical loads to the fullest extent of the freedom of the housing 21 relative to the panel plate 2.

Such mechanical loads will repeatedly act upon the two members every time when the mating connector 30 is connected and disconnected to and from the connector body 20. As a result, there is a risk of failures such as cracks and peelings in connections between printed circuits on the circuit board 1 and contacts of the connector body 20, and even in the printed circuits themselves.

To prevent this, it is conceivable that the socket 21*a* of the housing 21 is partially cut and bent to form flanges along the front and rear faces of the panel plate 2 and then the flanges are fixed to the panel plate by set screws. In many cases, however, the panel plate forms a casing of an electrical appliance so that it is in general made of a metallic material. With the electrical appliance requiring to electrically insulate between the panel plate 2 and the connector body 20, therefore, it is impossible to employ the fixing method for the housing 21 using the flanges extending therefrom.

To solve this problem, it is also conceivable that clamp members made of a resin are previously secured to the outer periphery of the housing 21 of the connector body 20 for fixing the housing 21 to the panel plate 2 maintaining the electrical insulation therebetween. As described above, however, the connector body must be moved along the surface of molten solder in a bath at high temperatures in the soldering process, so that the clamp members made of the resin are likely to be deformed due to the exposure to the high temperature, making difficult the handling of the clamp members. If a resin much higher in heat resistance is used for the clamp members, this problem may be solved. However, it may probably limit the resins to be used for the clamp members, increasing the cost of the connector.

SUMMARY OF THE INVENTION

It is an object of the invention to provide an improved mount of an electrical connector which comprises a resin clamp holder to be mounted in a later process on the housing of a connector body which has been previously fixed to a circuit board of an electrical appliance, thereby enabling the resin clamp holder, the housing of the connector body and a panel plate of the electrical appliance to be integrally fixed to one another and, if required, to obtain the insulation therebetween, in order to eliminate all the disadvantages of the prior art described above.

To this end, in a mount of an electrical connector including a connector body to be secured to a circuit board of an electrical appliance and having a housing as its outer casing whose mating connector socket is positioned in and spaced from the connector opening formed in a panel plate of said electrical appliance, according to the invention the mount comprises a clamp holder made of a resin and having a fitting portion to be fitted on the outer circumference of said housing of the connector body secured to the circuit board, said fitting portion being to be fixed to said panel plate in the state of said fitting portion being fitted on said outer circumference of said housing of the connector body so that said clamp holder made of the resin, said housing of the connector body and said panel plate are integrally fixed to one another.

In another aspect of the invention, the housing of the connector body and the panel plate of the electrical appliance are made of metallic or conductive materials, and by fixing the clamp holder made of the resin to the panel plate, the clamp holder made of the resin, the housing of the connector body and the panel plate are integrally fixed to one another, while insulation between the housing of the connector body and the panel plate is achieved.

As can be seen from the above explanation, the mount of the electrical connector according to the invention has following significant advantages.

(1) First, the clamp holder as the mount, the housing of the connector body and the panel plate can be integrally fixed to one another by employing the resin clamp holder, whereby the stable fixation of the connector body is obtained, even in case of any unsuitable inclined insertion or mishandling insertion of the mating connector.

Therefore, no undue load acts upon the circuit board to which the connector body is attached. Even if unsuitable insertion of the mating connector such as the inclined insertion is repeatedly effected, such a no-load condition on the circuit board considerably reduces the risk of failures such as cracks and peeling in connection between the circuit board and the connector body and in printed circuits themselves on the circuit board. Thus, the high reliable mount of the electrical connector is obtained.

(2) Moreover, even if the housing of the connector body and the panel plate of the electrical appliance are made of metallic or conductive materials, the fixation of those components by means of the interposition of the resin clamp holder therebetween serves to maintain the insulation between the housing and the panel plate in a good condition.

(3) Furthermore, as the resin clamp holder is mounted in a later process on the housing of a connector body previously fixed to a circuit board of the electrical appliance, in order to fix the housing of the connector body to the circuit board it is possible to use the flow soldering with a bath of molten solder or reflow soldering which is superior in productivity resulting in reduction of manufacturing cost.

Since the resin clamp holder is mounted in the later process, the material for the clamp holder is not limited to particular resins, and there is no risk of deformation of the resin clamp holder because of no chance of being heated.

(4) Moreover, as the resin clamp holder can be simply fixed to the housing of the connector body as by means of set screws from outside of the panel plate after the clamp holder has been arranged on the housing of the connector body fixed to the circuit board, such a fixation of the clamp holder is performed with a good operation efficiency without requiring any skillfulness.

The invention will be more fully understood by referring to the following detailed specification and claims taken in connection with the appended drawings.

DESCRIPTION OF THE PREFERRED EMBODIMENTS

Figure 1:
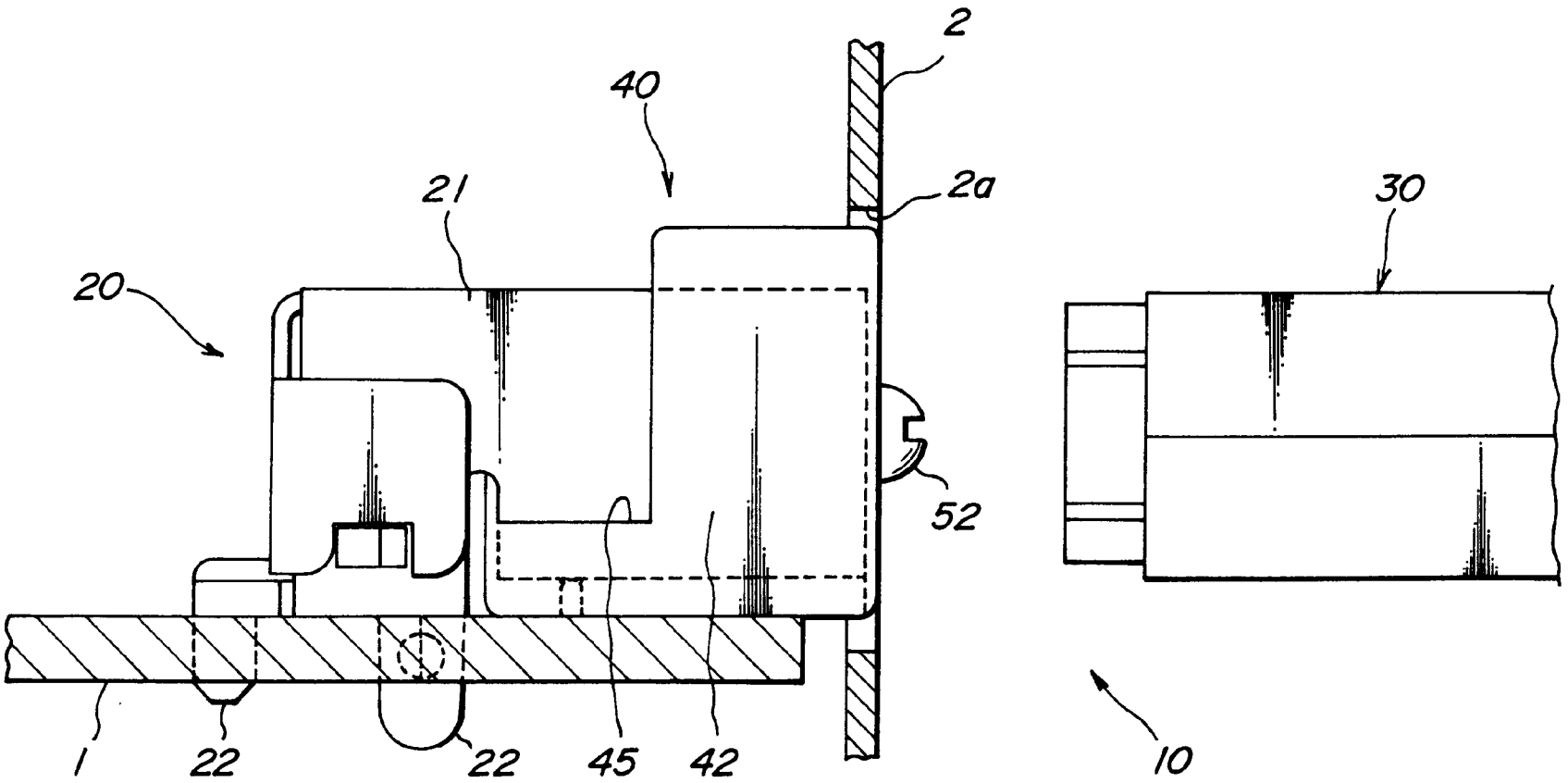
FIG. 1 is a partly longitudinal-sectional view showing one example of the mount of an electrical connector according to the invention.
Figure 2:
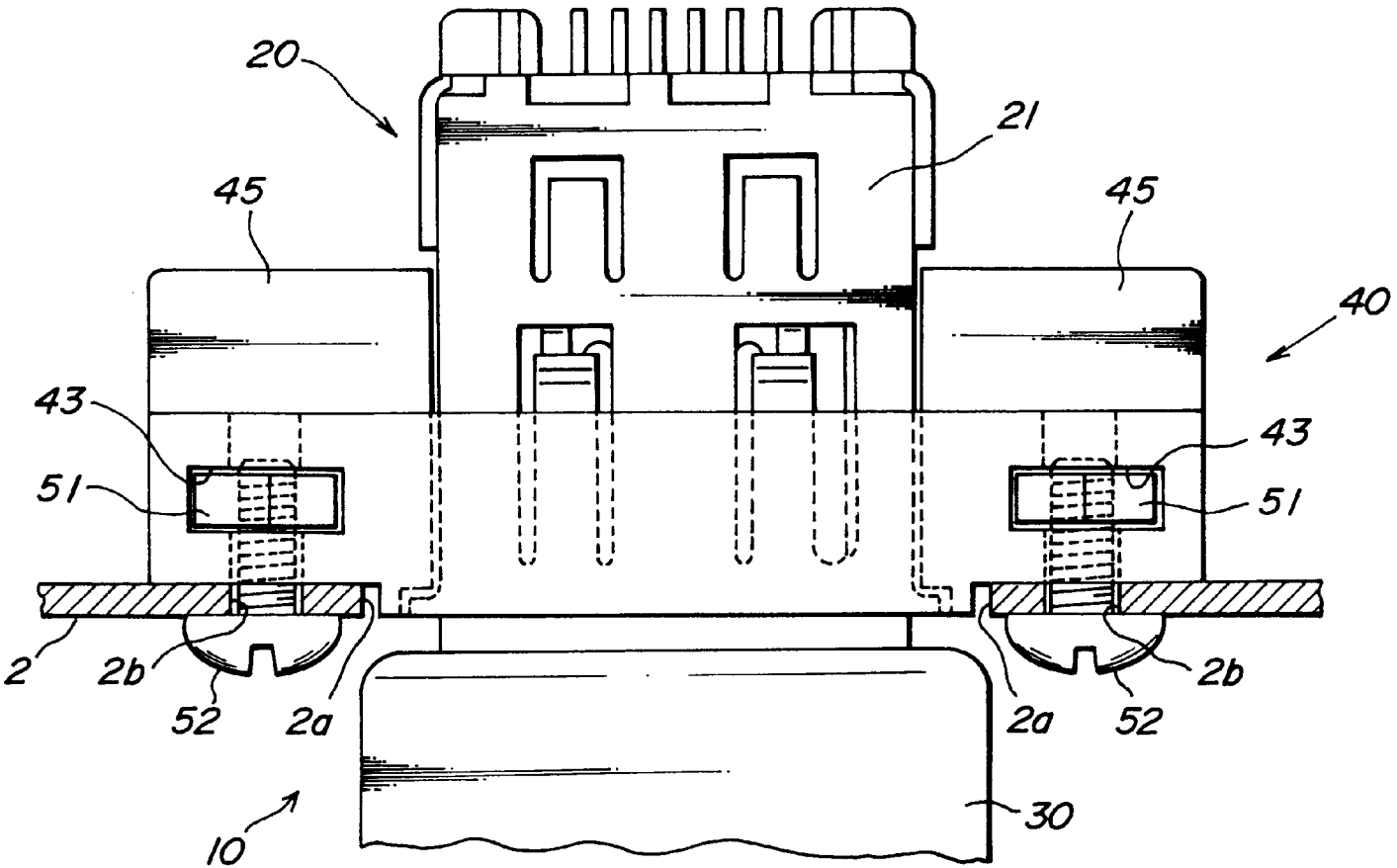
FIG. 2 is a partly cross-sectional view of the mount of the electrical connector shown in FIG. 1.

FIGS. 1 and 2 illustrate one example of the aspect for carrying out the mount of the electrical connector according to the invention. In the illustrated embodiment of the invention, one connector body 20 of an electrical connector 10 is mounted on a circuit board 1 arranged in an electrical appliance in a manner such that a mating connector socket 21*a* forming part of the housing 21 of the connector body 20 as its outer casing is positioned in and spaced from the connector opening 2*a* formed in a panel plate 2 as part of a casing of the electrical appliance, thereby enabling a mating connector 30 to be inserted from the outside into the socket 21*a* of a connector body 20, similarly to those shown in FIGS. 5 and 6.

The housing 21 of the connector body 20 is made of a metallic material, for example, a copper plate coated with nickel plating or solder layer. The housing 21 is provided on its bottom side with a plurality of legs 22 for fixing the housing to the circuit board 1. The legs 22 are fitted in fixing apertures (through-holes) formed in the circuit board 1 at predetermined positions and then fixed there at by flow soldering method using a bath of molten solder which is also similar to in FIGS. 5 and 6.

Figure 5:
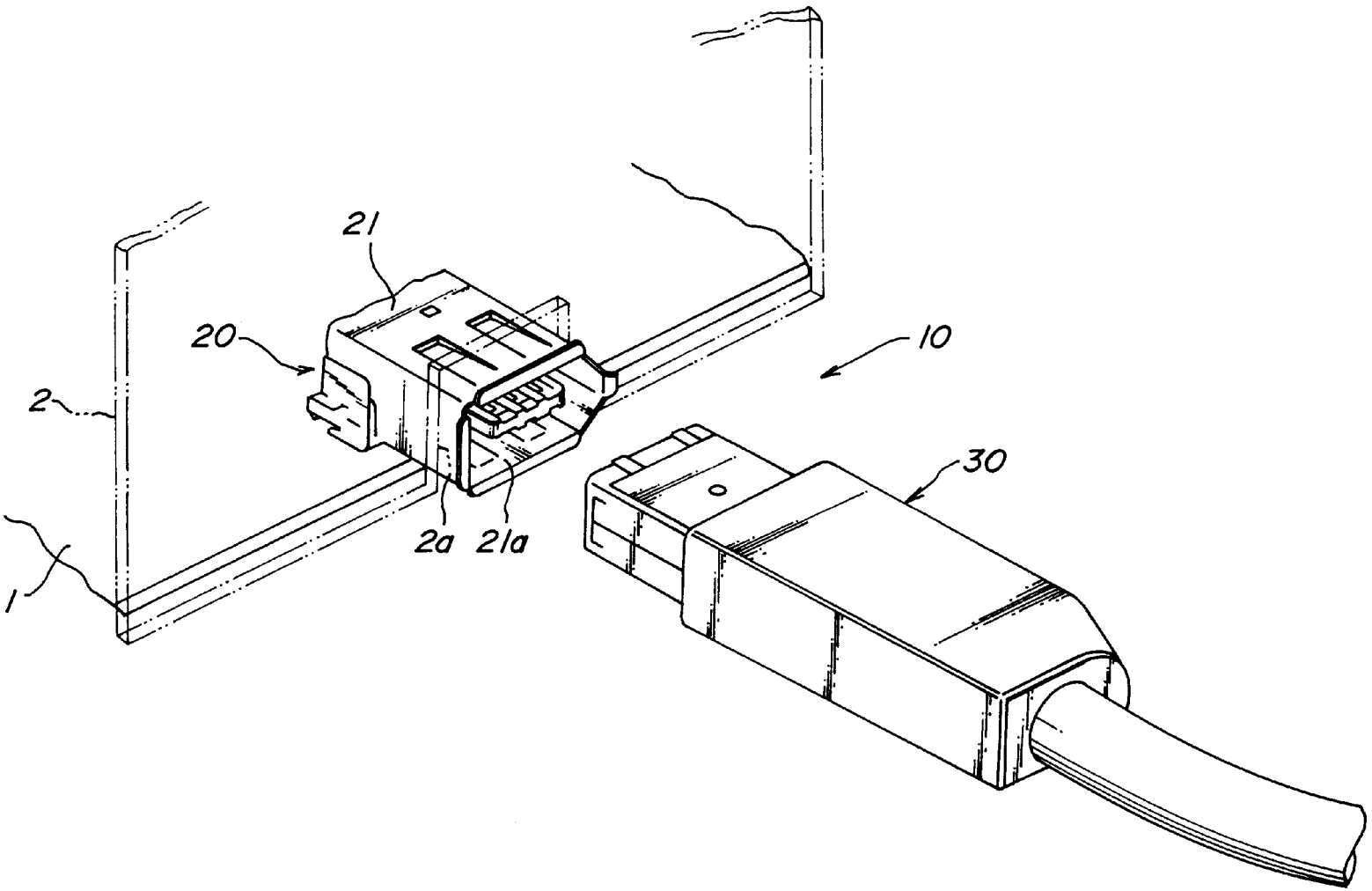
FIG. 5 PRIOR ART
FIG. 5 is a perspective view showing the outline of the mount of the electrical connector of the prior art.
Figure 6:
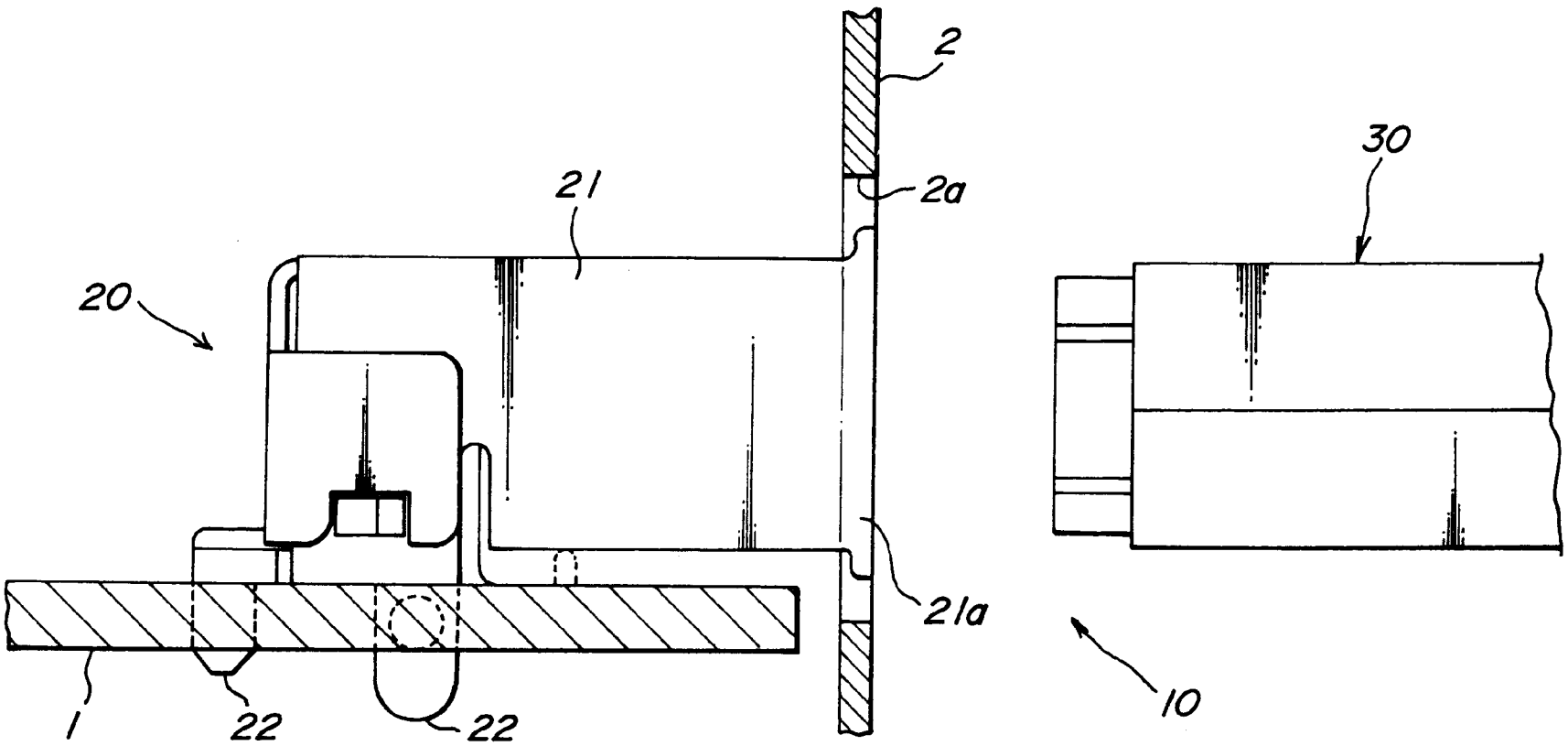
FIG. 6 PRIOR ART
FIG. 6 is a partly longitudinal-sectional view showing the mount of the electrical connector in FIG. 5; and, FIG. 7 is a perspective view illustrating the bottom surface of the housing in the mount of the electrical connector in FIG. 5.
Figure 7:
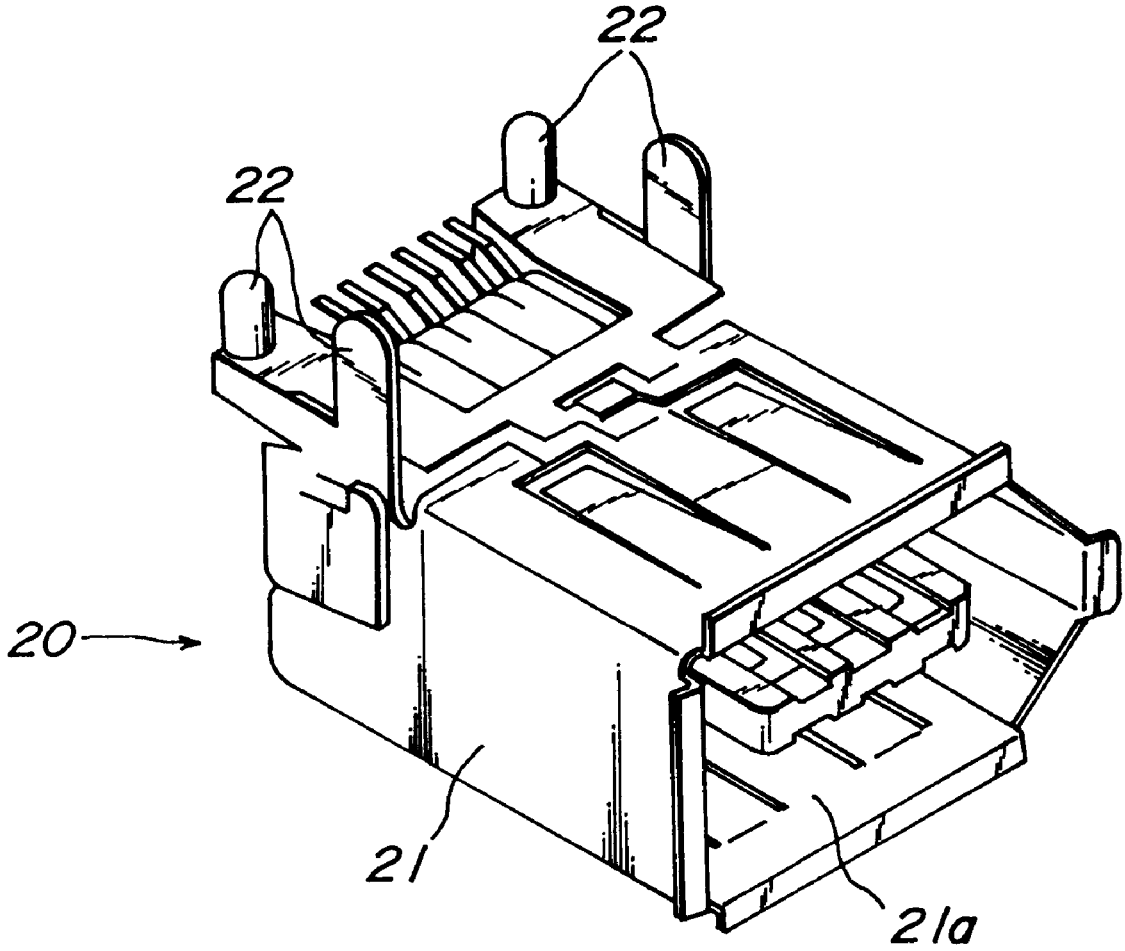
FIG 7 PRIOR ART

Significantly different from that of the prior art shown in FIGS. 5 and 6, there is provided a mount of the electrical connector according to the invention. The mount is constructed as a clamp holder 40 made of a resin substantially in the form of a gate. The resin clamp holder 40 is made of an electrically insulating resin, for example, 66 nylon (trade name), PBT (polybutylene terephthalate), 46 nylon (trade name) or the like.

Figure 4:
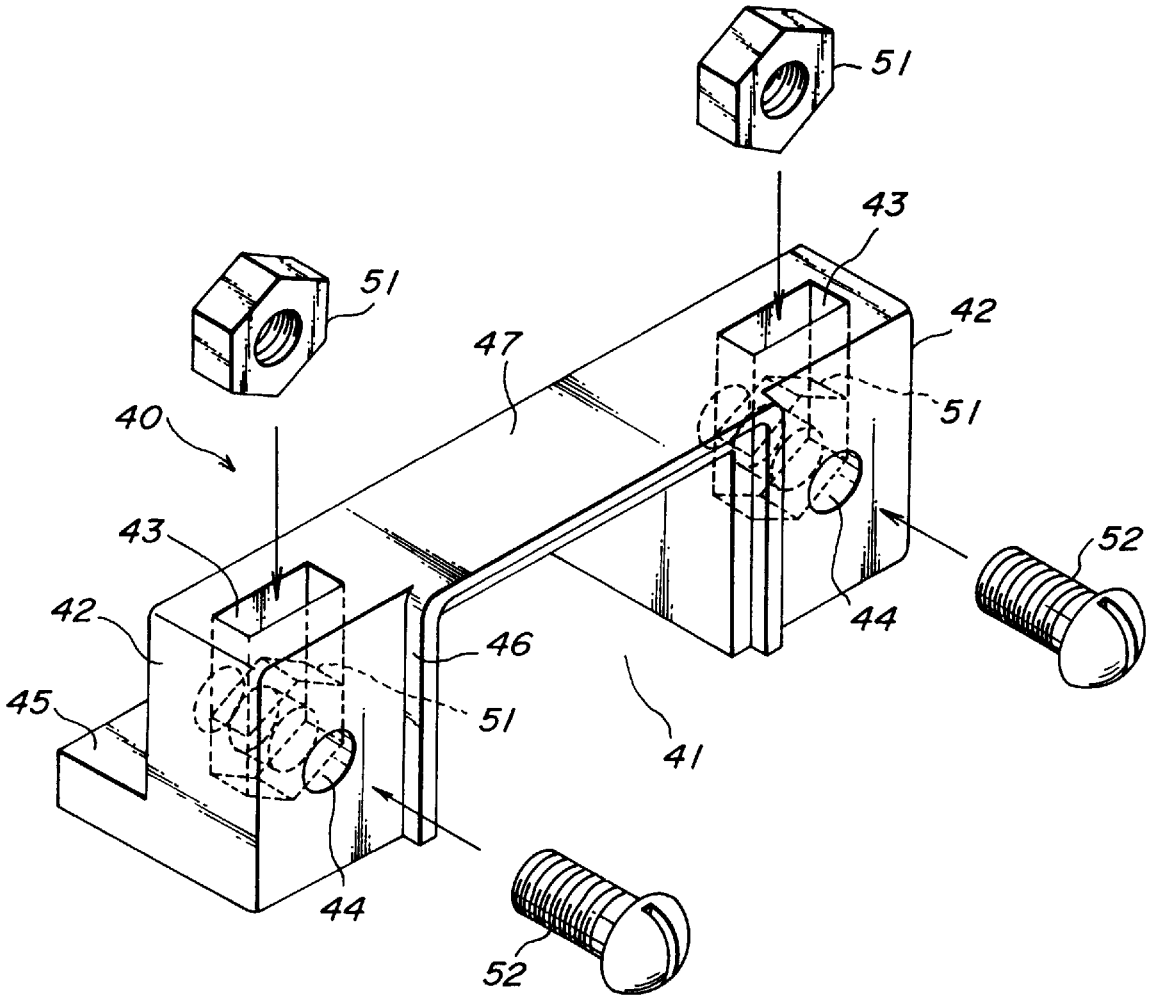
FIG. 4 is a perspective view showing one example of the resin clamp holder used in the mount of the electrical connector according to the invention.

The resin clamp holder 40 in the form of the gate has in its inside an inverted U-shaped portion forming a fitting portion 41 to be fitted on the outer periphery of the housing 21 of the connector body 20 as shown in FIG. 4.

The resin clamp holder 40 comprises on both sides gateposts (upright posts) 42 having receiving cavities 43 in the form of blind holes extending downward from the upper surface of the ceiling portion 47 of the resin clamp holder 40 for accommodating female fastening members 51 such as nuts. Each of the gateposts 42 is formed with an anchoring aperture 44 in a direction substantially perpendicular to the receiving cavity 43. A male fastening member 52 such as a set screw is inserted through each the anchoring aperture 44 and is tightly screwed in the female fastening member 51 received in the receiving cavity 43.

Each of the gateposts 42 is further provided with flange-like base 45 (only one shown in FIG. 4) on the opposite side of the male fastening member 52 with respect to the resin clamp holder 40. Finally, the fitting portion 41 is provided with ribs 46 slightly protruding from its periphery on the front side (on the side of the male fastening members 52), which are to be fitted in the connector opening 2*a* of the panel plate 2.

With this arrangement, the housing 21 of the connector body 20 is integrally fixed to the circuit board 1 and the panel plate 2 using the resin clamp holder 40 in the following manner.

Figure 3:
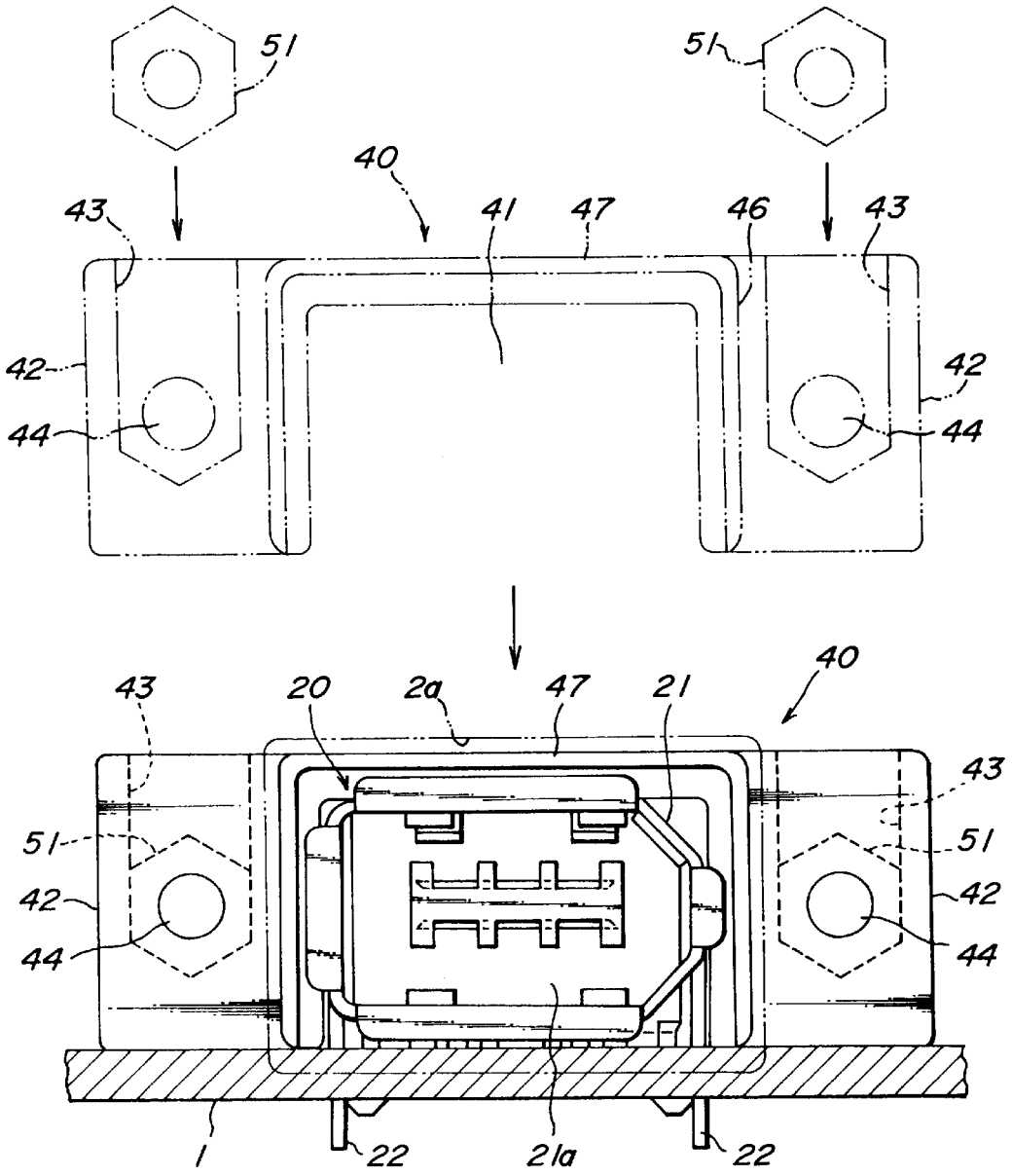
FIG. 3 is a partly longitudinal-sectional front view showing one step for fitting the resin clamp holder to the housing according to the invention.

First, as shown in FIG. 3, the resin clamp holder 40 is brought from above onto the housing 21 of the connector body 20 so that the fitting portion 41 of the resin clamp holder 40 is fitted on the outer circumference of the housing 21 of the connector body 20. In other words, both the gateposts 42 are slidden along both the side surfaces of the housing 21 so as to abut there against, while the ceiling portion 47 of the resin clamp holder 40 is urged against the upper surface of the housing.

Under this condition, male fastening members 52 such as set screws are then inserted from the outside of the panel plate 2 through fixing apertures 2*b* of the panel plate 2 into the anchoring apertures 44 of the resin clamp holder 40 and tightly screwed into the female fastening members 51 such as nuts received in the receiving cavities 43.

In this manner, the resin clamp holder 40 is rigidly fixed to the rear face of the panel plate 2, while both the side surfaces of the housing 21 are embraced between the both the gateposts 42 and the upper surface of the housing 21 is pressed downward by the ceiling portion 47 of the clamp holder 40 so that the resin clamp holder 40, the housing 21 of the connector body 20 and the panel plate 2 are fixed together to one another as an integral unit.

Accordingly, the mount of the connector thus constructed according to the invention is not sensitive to unsuitable insertion and not sensitive to mishandling insertion so that the connector body 20 is always fixed to an electrical appliance with a high stability. Furthermore, as the resin clamp holder 40 is made of an insulating resin, even if the housing 21 of the connector body 20 and panel plate 2 are made of metallic or conductive materials, the insulation therebetween can be satisfactorily achieved.

While the connector body 20 is shown to have a substantially hexagonal cross-section in the above embodiment, it will be apparent that any other shapes in cross-section for the connector body 20 may be employed, such as rectangular, circular and the like. In this case, the shape of the fitting portion 41 of the resin clamp holder 40 is of course changed correspondingly to the shape employed for the connector body 20.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector having a mount, said connector including a connector body secured to a circuit board of an electrical appliance and having a housing comprising an outer casing, said housing having a mating connector socket positioned in and spaced from a connector opening formed in a panel plate of said electrical appliance, said mount comprising a clamp holder made of a resin and having a fitting portion fitted on the outer circumference of said housing of the connector body secured to the circuit board, said fitting portion adapted to be fixed to said panel plate in the state of said fitting portion being fitted on said outer circumference of said housing of the connector body so that said clamp holder made of the resin, said housing of the connector body and said panel plate are integrally fixed to one another, wherein said clamp holder is mounted on said housing of the connector body by lowering the clamp holder from above onto said housing of the connector body, sliding gateposts of said clamp holder along side surfaces of said housing to bring them into abutment thereagainst and to urge a ceiling portion of the clamp holder against an upper surface of said housing, inserting male fastening means from outside of the panel plate through fixing apertures of said panel plate into anchoring apertures of said clamp holder and screwing said male fastening means into female fastening means received in receiving cavities formed in the clamp holder.

2. The mount of the electrical connector as set forth in claim 1, wherein said housing of the connector body and said panel plate of the electrical appliance are made of metallic or conductive materials, said clamp holder being fixed to said panel plate so that said clamp holder, said housing of the connector body and said panel plate are integrally fixed to one another, while insulation between said housing of the connector body and said panel plate is achieved.

3. The mount of the electrical connector as set forth in claim 1, wherein said fitting portion of the clamp holder is provided along the periphery thereof in a front side thereof with a slightly protruding rib to be fitted on the inside of said connector opening of the panel plate.

* * * * *